US005309803A

United States Patent [19]

Penniman

[11] Patent Number: 5,309,803

[45] Date of Patent: May 10, 1994

[54] SYSTEM INCLUDING METHOD AND APPARATUS FOR CUTTING EACH LAYER OF A DOUBLE-LAYERED ROLL OF SHEET TO DIFFERENT LENGTHS AND WIDTHS

[76] Inventor: David T. Penniman, Roaring Brook Rd., Prospect, Conn. 06712

[21] Appl. No.: 970,478

[22] Filed: Nov. 2, 1992

Related U.S. Application Data

[63] Continuation-in-part of Ser. No. 518,179, May 3, 1990, abandoned.

[51] Int. Cl.[5] ..... B26D 3/12

[52] U.S. Cl. ..... 83/13; 83/440; 83/443; 83/407; 83/858; 83/47; 83/425.4

[58] Field of Search ..... 83/47, 440, 440.1, 441.1, 83/443, 448, 856, 857, 13, 404.3, 407, 858, 418, 425, 425.2, 425.3, 425.4, 869; 156/511, 517

[56] References Cited

U.S. PATENT DOCUMENTS

| | | | |
|---|---|---|---|
| 917,366 | 4/1909 | Schwartz | 83/440 |
| 3,916,743 | 11/1975 | Naudascher et al. | 83/425.4 |
| 4,175,460 | 11/1979 | McPhail | 85/856 |
| 4,214,495 | 7/1980 | Coburn | 83/425.4 |
| 4,312,255 | 1/1982 | Holmström | 83/856 |
| 4,656,910 | 4/1987 | Peterson | 83/856 |

FOREIGN PATENT DOCUMENTS

| | | | |
|---|---|---|---|
| 3027487 | 2/1982 | Fed. Rep. of Germany | 83/425.4 |
| 2123738 | 2/1984 | United Kingdom | 83/448 |

*Primary Examiner*—Eugenia Jones
*Assistant Examiner*—Allan M. Schrock
*Attorney, Agent, or Firm*—CTC & Associates, Inc.

[57] ABSTRACT

Method and portable apparatus for separately cutting respective layers of sheet of double-layered sheets which includes a portable apparatus with a pair of adjustable upper and lower parallel cutting assemblies each having angularly oriented cutting blades for separately cutting each sheet in parallel as they are pulled through the upper and lower cutting assemblies.

2 Claims, 5 Drawing Sheets

SYSTEM INCLUDING METHOD AND APPARATUS FOR CUTTING EACH LAYER OF A DOUBLE-LAYERED ROLL OF SHEET TO DIFFERENT LENGTHS AND WIDTHS

This is a continuation-in-part of U.S. patent application Ser. No. 07/518,179 first filed on May 3, 1990 herewith abandoned.

This invention relates to the simultaneous cutting of two layers of plastic sheeting, simultaneously cutting each layer to a different dimension for simultaneous installation of the cut layers and to seal each layer individually to a building component such as a wall.

Laws in most states now require that floors and walls be temporarily covered with two layers of polyethylene 4 mils (0.010 cm) or 6 mils (0.015 cm) thick during asbestos removal operations. Each layer being individually adhered to the wall or ceiling with duct tape. At present, polyethylene is sold to asbestos removal contractors in a single layer which is folded several times and then rolled into a packaging carton, but it is not dispensable from a roll.

A patentability search hereon has revealed the following U.S. patents:

| U.S. Pat. No. | Date | Inventor(s) |
|---|---|---|
| 2,703,612 | March 8, 1955 | Nye et al. |
| 3,137,455 | June 6, 1964 | Bonura |
| 3,467,332 | September 16, 1969 | Bachman |
| 4,526,683 | July 2, 1985 | Clements |
| 4,645,558 | February 24, 1987 | Sato |

Nye et al. is apparatus for cutting plastic sheets made from cellophane, Pliofilm, or other substances such as vinyl. The apparatus cuts the plastic sheets into a plurality of small strips of substantially the same length, the sheets are single ply.

Bonura teaches a plastic bag machine utilizing a supply roll carrying a rolled sheet of a large plurality of collapsed plastic bags joined end to end. The machine transports a predetermined number of bags joined end to end to a transfer station, counts the number of bags and causes a transverse severance when the predetermined number of bags is counted and rolls the predetermined number of severed bags on a tube.

Bachman relates to apparatus for cutting sheets of flexible plastic material into trapezoidal shapes, the cut trapezoidal sheets being suitable for use as intermediate layers of laminated safety glass windshields. The trapezoidal sheets are cut from a continuous web of the plastic material.

Clements discloses apparatus and method for joining an expiring web of plastic material to a fresh web of plastic material.

Sato is a machine for feeding a packaging sheet with registered marks to a working machine, such as a packaging machine that wraps products. The feeding of the sheet is rapid and continuous and one operator can watch and control a plurality of machines.

The prior art patents found in the search do not appear to deal with the problem solved by the present invention or offer any solution to that problem.

SUMMARY OF THE INVENTION

The invention greatly reduces on-site labor required to install polyethylene sheeting for asbestos removal projects. As stated, polyethylene is now sold to asbestos removal contractors in single layers each folded several times and rolled into a packaging carton. It is time-consuming and expensive to cut such single layers to individual size and to install same against walls and ceilings and subsequently sealing the first layer to the same with duct tape then sealing the second layer to the duct tape used to seal the first layer.

The invention entails the apparatus and method of separately cutting each layer of a double-layered roll of sheeting, such as polyethylene, in which the layers are lightly adhered together. The double layered roll is mounted for rotation on a horizontal shaft, so that as the two layers are simultaneously withdrawn from the roll there is an upper layer and a lower layer, each with a left edge and a right edge. The upper and lower layers of the roll are separated from each other only near their left edges and near their right edges. The thus separated upper and lower layers are drawn past upper and lower left cutters and upper and lower right cutters. The upper left and right cutters are mirror images of each other and the lower left and right cutters are mirror images of each other. The cutters sever respective layers to customized desired width, typically different for the upper and lower layers. The spacing between the left and right upper cutters and the spacing between the left and right lower cutters is adjustable. Typically such spacing may be on the order of 7 to 8 feet (2.13 to 2.44 m). When the desired length of the upper and lower layers has passed the cutters, it is transversely severed from the remainder of the double-layered roll and the so severed but still lightly adhered layers are installed at the required location, as for example a wall, all in a much simplified manner with regard to the prior art.

The widths of the severed lightly adhered layers may become the height of the layers installed on a wall, in which case the length of the severed layers will become the width of the installed layers.

From the foregoing, it is apparent that it is an important object of the invention to provide a method and apparatus for cutting and handling double layered rolls of plastic sheeting, cutting each layer to a different horizontal dimension; for use in operations in which hazardous or carcinogenic substances are removed from structures.

It is another important object of the invention to provide a method and apparatus which is much less awkward and time-consuming and much less expensive to use in on-site asbestos removal operations, when compared to the prior art.

It is a further important object of the invention to provide an apparatus which is portable, being easily set up anywhere it is desired to use same.

These and other objects and advantages will appear hereinafter.

DESCRIPTION OF THE INVENTION

Figure 1:
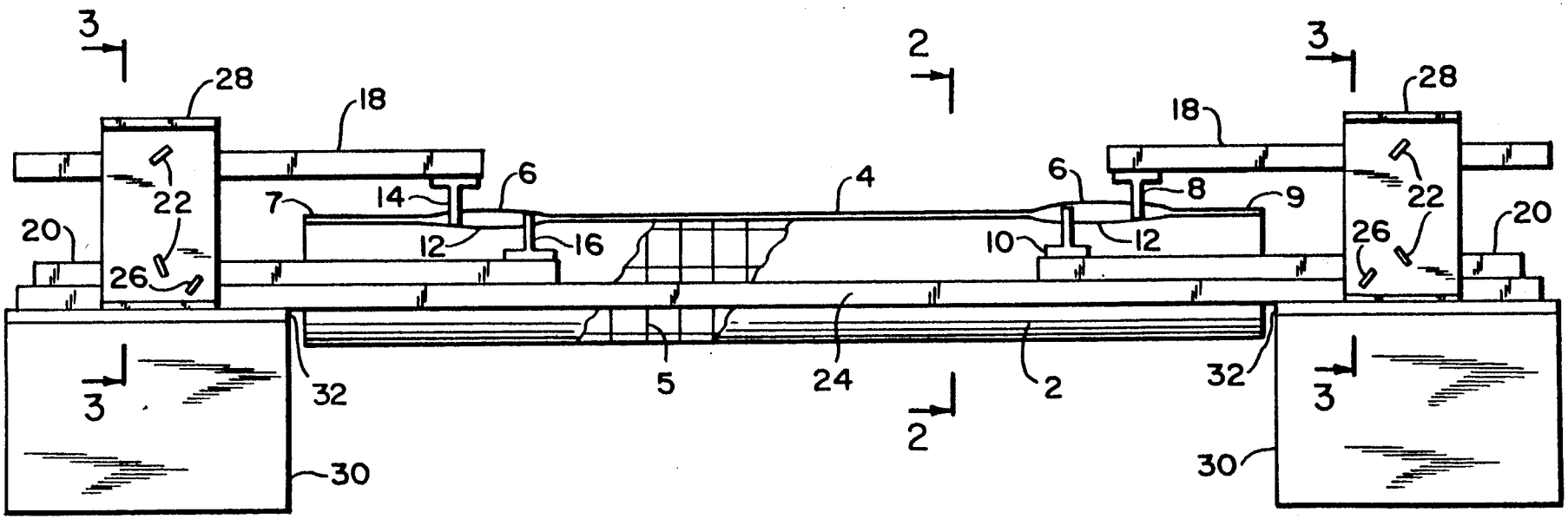
FIG. 1 is a somewhat schematic front elevation of a system that is a preferred embodiment of the invention for cutting a double-layered roll of sheet to desired width.

As stated, FIG. 1 is a somewhat schematic elevation of the apparatus that is a preferred embodiment of the invention. The illustrated apparatus operates on a roll 2 of double-layered or sheets which are lightly adhered together. Roll 2 is thus a double-layered roll of sheet, which can be referred to as a duplex roll of sheets.

More particularly, layers 4 include a top or outer layer 6 and a bottom or inner layer 12 that have coextensive confronting faces and are separable from each other in a manner and for a purpose explained hereinafter. Layers 4 may typically have a width of 8 to 10 feet (2.4 to 3.0 meters).

The system includes means for supporting roll 2 for rotation with its axis horizontal, so that as roll 2 is unwound it will have a left edge 7 and a right edge 9. This supporting means includes a rigid horizontal cylindrical member (of steel, for example) shown in FIGS. 2 and 3 as a pipe 42 but which alternatively could be a shaft.

The system further includes top and bottom left cutting assemblies 14 and 16, respectively, and top and bottom right cutting assemblies 8 and 10, respectively. Top cutting assemblies 14 and 8 are mirror images of each other, and bottom cutting assemblies 16 and 10 are mirror images of each other.

The system further comprises two adjustable left and right support arms 18 which support top cutting assemblies 14 and 8, respectively, and two adjustable left and right support arms 20 which support bottom cutting assemblies 16 and 10, respectively. A spreader bar 24 is provided for the purpose of roughly spacing top cutting assemblies 14 and 8 from each other and bottom cutting assemblies 16 and 10 from each other.

The system also comprises left and right channel assemblies 28, respectively, which may be of steel and which hold spreader bar 24. Left channel assembly 28 also holds left support arm 18 and left support arm 20, while right channel assembly 28 also holds right support arm 18 and right support arm 20. Left and right support arms 18 extend toward each other from left and right channel assemblies 28, respectively, as do left and right support arms 20. The spacing between the confronting ends of arms 18 and between the confronting ends of arms 20 can be adjusted within wide limits and arms 18 and 20 can be locked in desired positions by thumb screws 22. Channel assemblies 28 can be slid along spreader bar 24 and locked in desired positions by thumb screws 26.

The system additionally comprises left and right supports such as plastic "milk" crates or cases 30 or other similarly dimensioned support, respectively, to which plywood tops 32 are attached. Channel assemblies 28 are attached to plywood tops 32.

It has been found that the needs of cutting assemblies 14, 16, 8 and 10 can admirably be filled by Stationary Cutter Model #25 manufactured by SAFETCUT, Inc., P.O. Box 466, Palmer, Mass. 01069. Cutter #25 is a well known design which is used for cutting twine, paper, plastic sheet and the like. It has a base and upper arm and angled razor blade. The base and arm forming a slot into which the item to be cut is inserted the item is then pulled against the razor blade cutting surface. The slot acting to guide the item inserted therein against the razor blade cutting surface. The slot also acting to prevent inadvertent contact with fingers etc.

Figure 2:
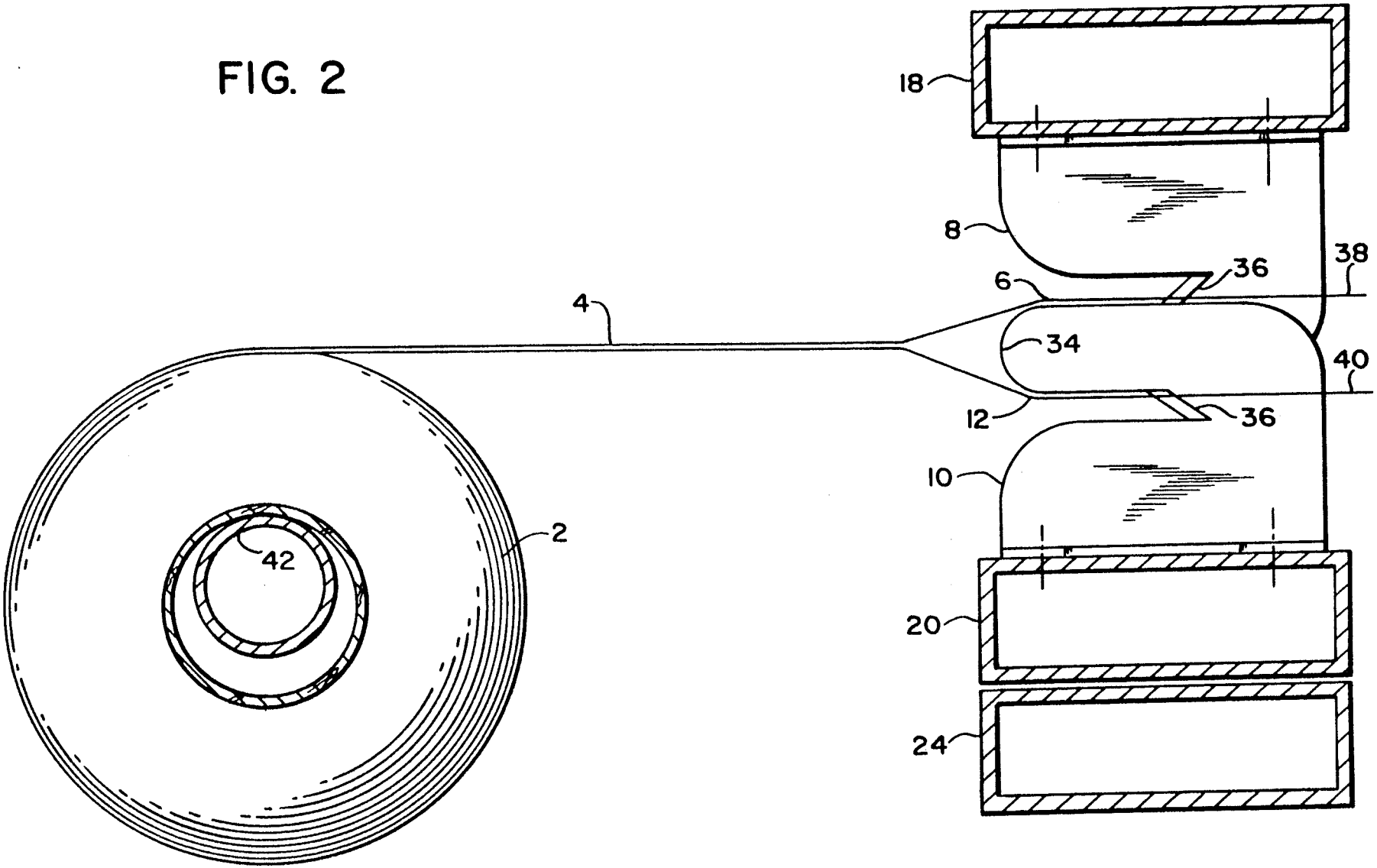
FIG. 2 is an enlarged somewhat schematic sectional view taken on line 2—2 of FIG. 1.
Figure 3:
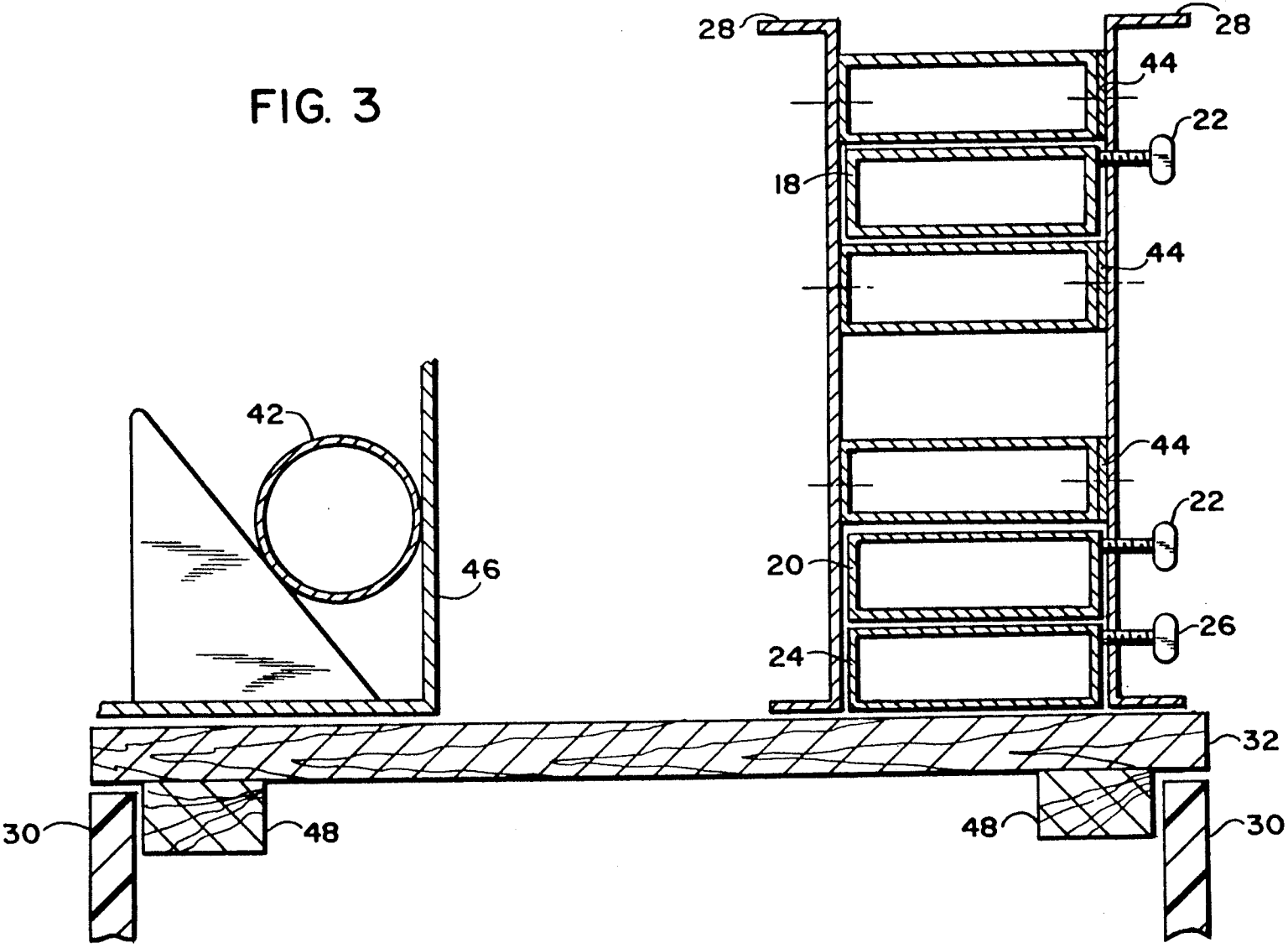
FIG. 3 is an enlarged somewhat schematic sectional view taken on either line 3—3 of FIG. 1.

FIGS. 2 and 3 show the operative elements of right channel assembly 28, it being understood that the elements of left channel assembly 28 are the same as the elements of right channel assembly 28. Those elements of right channel assembly 28 include, from bottom to top, spreader bar 24, adjustable support arm 20, bottom right cutting assembly 10, top right cutting assembly 8 and adjustable support arm 18.

Bottom right cutting assembly 10 is mounted on and movable with adjustable support arm 20, while top right cutting assembly 8 is mounted on and movable with adjustable support arm 18. Bottom right cutting assembly 10 has a convexly rounded leading edge 34, and top right cutting assembly 8, which is inverted with respect to and directly behind assembly 10, likewise has a convexly rounded leading edge, which is horizontally aligned with leading edge 34 of assembly 10. The leading edge of top assembly 8 is hidden from view in FIG. 2 because it is immediately behind leading edge 34 of bottom assembly 10. Each of top and bottom assemblies 8 and 10 has a razor blade 36 to cut the sheet. Razor blades 36 are angularly related to the direction of travel of layers 6 and 12, making an angle of about 35 degrees to such direction.

Bottom left cutting assembly 16 is a mirror image of and structurally the same as bottom right cutting assembly 10 and top left cutting assembly 14 is a mirror image of and structurally the same as top right cutting assembly 8.

Leading edge 34 of bottom right cutting assembly 10 and the identical leading edges of assemblies 8, 14 and 16 facilitate separation of the two layers 6 and 12 but are not necessary of material coming off of roll 2 and pulled past assemblies 8, 10, 14 and 16, causing blades 36 of assemblies 8, 10, 14 and 16 to cut material coming off of roll 2 to two different widths. Top layer 6 of the sheet is cut to one width indicated at 38 while bottom layer 12 of the sheet is cut to another width indicated at 40.

Meanwhile, the same operation is proceeding at bottom left cutting assembly 16 and at top left cutting assembly 14.

As illustrated, top layer 6 is cut at 38 to a wider width than is bottom layer 12 at 40.

The locations of assemblies 8, 10, 14 and 16 are adjustable within fairly wide limits by adjusting the positions of adjustable support arms 18 and 20 toward and/or away form each other.

FIG. 3 shows spacers and shims 44 attached to channel assemblies 28 to provide proper operating clearances for support arms 18 and 20 and spreader bar 24. A cradle assembly 46 is also provided to support pipe shaft 42, and wood cleats 48 are used to secure plywood top 32 to plastic crate 30.

Figure 6:
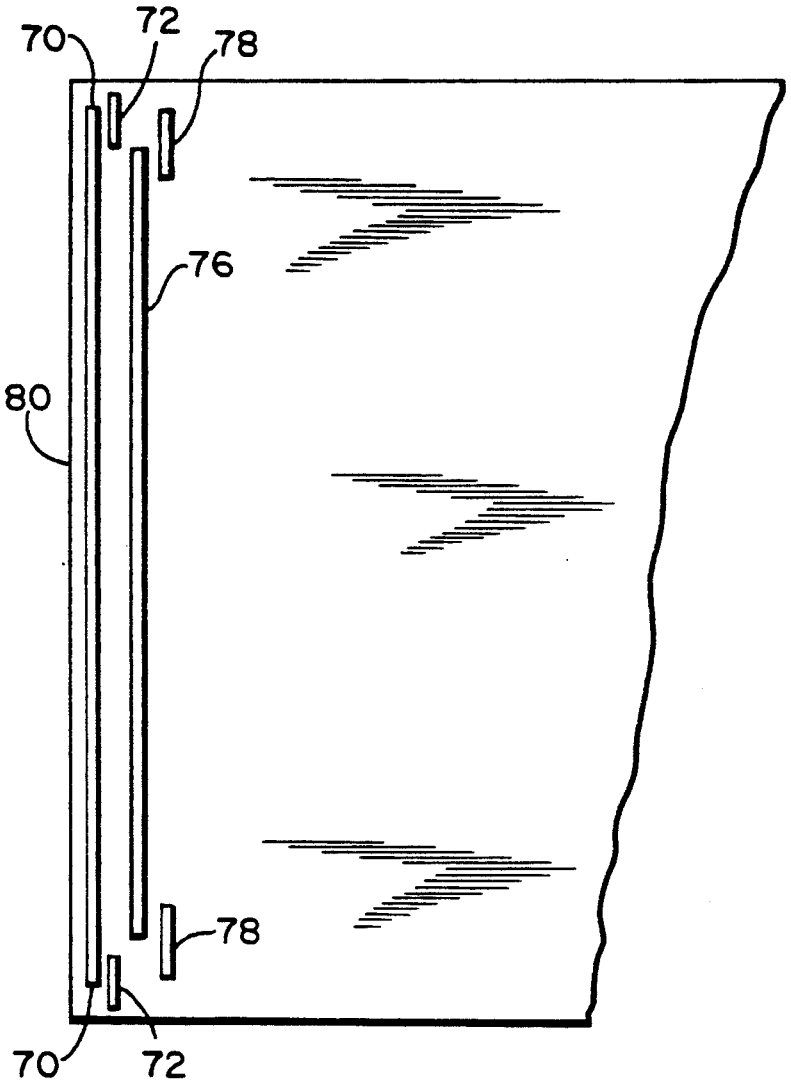
FIG. 6 illustrates the double layer plastic sheet cut to two different dimensions installed on a wall.

The customized cut sheet is then readily affixed and sealed to the desired surface such as a wall FIG. 6, wherein the first layer 70 which has been cut to greater width and which becomes the length on the wall, is sealed to the wall 80 at top and bottom FIG. 6 with first layer of duct tape 72. Second layer of sheet 76 which has been cut to lesser width and which becomes length on the wall, is then sealed to first layer 70 at and over first layer of duct tape 72 with second layer of duct tape 78. This method of sealing conforms to Federal mandates.

Figure 4:
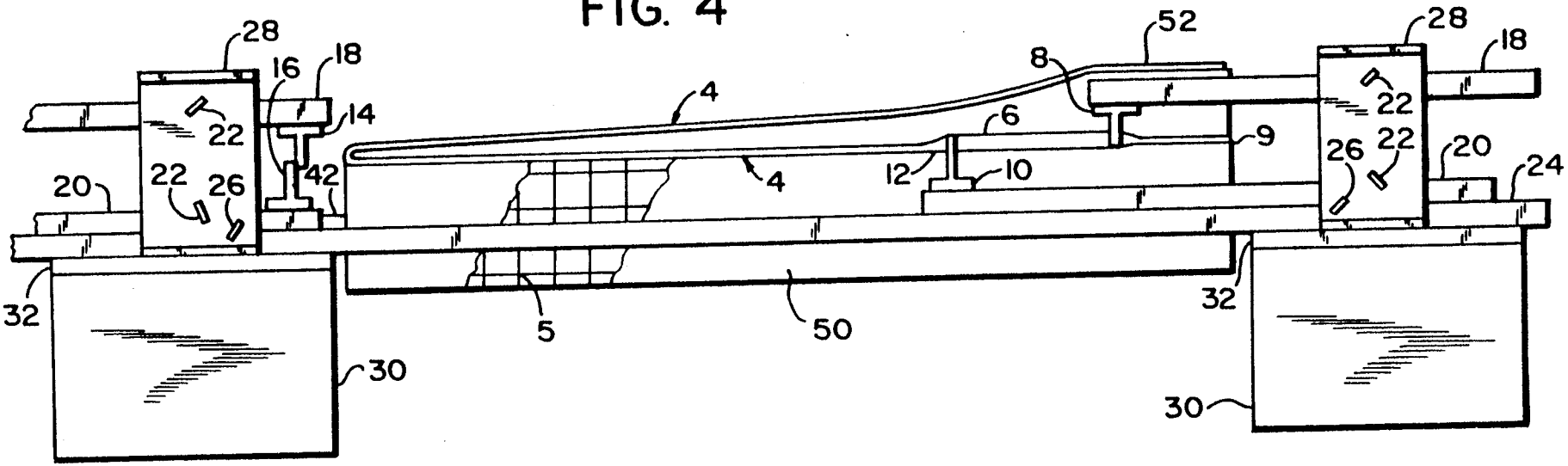
FIG. 4 is a view similar to FIG. 1 but showing an adaptation of the apparatus for cutting a double-layered roll of sheet of increased width.

FIG. 4 shows an adaptation of the apparatus of FIGS. 1, 2 and 3 for use in cutting a double-layered roll of sheet of increased width. The roll which can be handled with the apparatus of FIGS. 1, 2 and 3, as a practical matter, may be limited to 8 to 10 feet (2.4 to 3.0 meters) in width. The apparatus of FIG. 4 can handle an increased roll width, up to 12 to 20 feet (3.7 to 6.1 meters).

FIG. 4 shows a roll 50 of sheet comprising two layers lightly adhered together and folded widthwise once before being rolled. This places the longitudinal edges of the rolled material in the same vertical plane, one edge being directly above the other, and substantially coincident. In this instance, adjustable support arms 18 and 20 which hold top left cutting assembly 14 and bottom left cutting assembly 16 have been retracted to positions in which assemblies 14 and 16 are inoperable.

As shown, roll 50 presents a top duplex layer 52 of folded sheet, and top right assembly 8 and bottom right assembly 10 will cut the sheet in two places. If additional cuts are required for top duplex layer 52, a second right hand cutting set-up (i.e., items 8, 10, 18, 20, 22, 26, 28, 30 and 32) could be mounted to the front side of the illustrated cutting set-up, at an elevation of 3.5 inches (8.9 cm) higher, to cut top duplex layer 52 as required.

Figure 5:
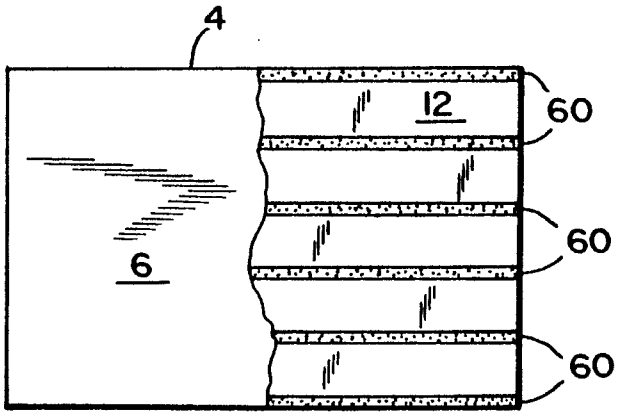
FIG. 5 is a somewhat schematic fragmentary plan view of a preferred double-layered sheet that is separately cut to different dimensions.

FIG. 5 illustrates a double-layered sheet or layers 4 including outer layer 6 a portion of which has been stripped away to reveal inner layer 12 on which appears a plurality of localized areas 60 to which adhesive for lightly adhering layers 6 and 12 together has been applied. Localized areas 60 extend laterally across layers 40 from left edge 7 to right edge 9. Areas 60 are parallel to each other and spaced about 1 foot (30.5 cm) apart and are each about 1 inch (2.54 cm) wide. As stated above, such arrangement is preferable to one in which the adhesive is applied to the entire confronting faces of layers 4 in terms of ease of handling.

The method of cutting each of two layers of double layered polyethylene sheeting involves mounting the double layered rolls of sheeting 2 on a horizontal shaft 42. The upper and lower layers 4 and 6 of sheeting are separated from each other near their right and left edges, care being taken not to fully separate the layers from each other. The thus separated upper and lower layers are drawn over cutting assemblies 8 and 10 on the right and 14 and 16 on the left. The cutters sever respective layers to desired width (which becomes length in installation) which is usually different for upper and lower layers. Because the adjustable spacing between left and right upper cutters and left and right lower cutters each of the layers may be severed to a different dimension.

When desired length (becomes width on installation on a wall) it is transversely severed from the remainder of dual sheet on the roll. The so severed but still lightly adhered layers are simultaneously carried to, for example a wall. The longer width 70 sheet (now length); is first sealed to the wall at the ceiling for example with duct tape 72. The shorter width 76 (now length) is sealed to the first layer and installed with a second layer of duct tape 76 as in FIG. 6. Subsequently in jurisdictions that require two individual layers of sheeting the first or inner layer 70 is sealed to the base of the wall with duct tape 72. The second layer 76 (outer then pulled away from the first layer and allowed to float down into place prior to sealing to the first layer with a second layer of duct tape 78. In jurisdictions wherein there is no requirement to install two separate individual layers, the latter separation step is eliminated directly sealing the adhered layers to the duct tape 72 installed on the first layer 70.

It is apparent that the invention well attains the stated objects and advantages and others.

The disclosed details are exemplary only and are not to be taken as limitations on the invention except as those details may be included in the appended claims.

What is claimed is:

1. A portable apparatus for simultaneously cutting each layer of a double layered roll of 0.004–0.006 inch (0.10–0.15 mm) thick plastic sheeting comprising means for supporting said roll for rotation with its axis horizontal; upper and lower left cutting assemblies and upper and lower right cutting assemblies; said upper left cutting assemblies and said upper right cutting assemblies being horizontally aligned with and mirror images of each other; said lower left and said lower right cutting assemblies being horizontally aligned with and mirror images of each other; upper adjustable left and right support arms to support said upper left and upper right cutting assemblies respectively; lower adjustable left and right support arms to support said lower left and right cutting assemblies respectively; a spreader bar to space said left adjustable support arms from said right adjustable support arms; left and right channel assemblies connected to said spreader bar which respectively support said upper and lower left and upper and lower right support arms, said left and right upper support arms extend toward each other, and said left and right lower support arms extend toward each other, said left and right channel assemblies slidably engage said spreader bar, said left and right channel assemblies having first clamping means to lock said lower left and right and upper left and right adjustable support arms to said channel assemblies and said left and right channel assemblies having second clamping means to lock said channel assemblies to said spreader bar.

2. A method of simultaneously cutting each layer of a roll of double layered 0.004–0.006 inch (0.10–0.15 mm) thick plastic sheeting to a different width utilizing the portable apparatus of claim 1 comprising mounting said roll onto a shaft, inserting said mounted roll and shaft into the apparatus in horizontal position, adjusting and clamping the left and right channel assemblies on the spreader bar, adjusting and clamping the upper left and upper right support arms and cutting assemblies mounted thereon to the desired width, adjusting and clamping the lower left and lower right support arms and cutting assemblies mounted thereon to the desired width, separating each of said layers at their right and left edges, to form upper left and right sheet edges and lower left and right sheet edges, inserting said upper left and right sheet edges into said upper left and right cutting assemblies respectively and inserting said lower left and right sheet edges into said lower left and right cutting assemblies respectively, pulling said double layered sheeting with separated upper left and right and separated lower left and right edges into and through said cutting assemblies to sever each of said layers of sheeting to customized widths.

* * * * *